United States Patent [19]

Minier et al.

[11] Patent Number: 4,566,824

[45] Date of Patent: Jan. 28, 1986

[54] SYSTEM FOR DRILLING FROM A WATER SURFACE, WHICH IS INSENSITIVE TO THE SWELL

[75] Inventors: Jean Minier, Limours; Hervé Barthélemy, La Celle Saint Cloud; Vincent Foglia, Aulnay sous Bois, all of France

[73] Assignee: Commissariat a l'Energie Atomique, Paris, France

[21] Appl. No.: 552,299

[22] Filed: Nov. 16, 1983

[30] Foreign Application Priority Data

Nov. 19, 1982 [FR] France ..... 82 19395

[51] Int. Cl.[4] ..... E02B 17/00; E21B 7/128

[52] U.S. Cl. ..... 405/202; 166/352; 175/7; 114/230

[58] Field of Search ..... 405/195, 202–205, 405/207, 208, 224; 114/230, 264, 265, 293; 166/351, 367, 355, 352, 354, 350; 175/7, 10, 9

[56] References Cited

U.S. PATENT DOCUMENTS

| | | | |
|---|---|---|---|
| 3,481,294 | 12/1969 | Vincent . | |
| 3,708,985 | 1/1973 | Pogonowski et al. | 405/202 |
| 4,126,010 | 11/1978 | Michel et al. | 405/202 |
| 4,137,722 | 2/1979 | Mossiossian et al. | 405/202 |
| 4,175,890 | 11/1979 | Taylor | 405/202 |
| 4,231,681 | 11/1980 | Tuson | 405/202 X |
| 4,268,191 | 5/1981 | Tuson | 405/202 X |

FOREIGN PATENT DOCUMENTS

| | | | |
|---|---|---|---|
| 1519891 | 4/1968 | France . | |
| 2421272 | 10/1979 | France . | |
| 2418839 | 11/1979 | France | 405/202 |
| 855219 | 11/1960 | United Kingdom . | |

*Primary Examiner*—Cornelius J. Husar
*Assistant Examiner*—Nancy J. Stodola
*Attorney, Agent, or Firm*—Michael N. Meller

[57] ABSTRACT

System for drilling from a water surface, of the type having means for exerting and maintaining on the drilling tool a bearing stress, which is constant and normal to the surface to be perforated, no matter what the effect of the swell, wherein it comprises in combination: a base having a central passage for the drill pipe string of a drilling apparatus, which is intended to rest on the sea bed and is elastically connected to means for receiving a cylindrical box; a column formed by a cylindrical tubular central guide, for permitting the passage and guidance of the drill pipe string of the drilling apparatus, the column being surrounded by an external cylindrical tubular envelope, the hollow annular space formed between the central guide and the envelope being subdivided into a tight member constituting the lower ballast, a tight intermediate member of variable length determined as a function of the mean value of the section of water under which drilling takes place, a tight member constituting an upper ballast and a head member, the total height of the column exceeding the maximum depth of the section of water, the lower cylindrical part of the column being shaped so that it is placed in the reception means of the base and the head member of the column supporting a platform for installing the drilling apparatus; and a barge moored to anchor lines on the site where drilling is to take place, which is provided with an annular collar for receiving with a clearance the head member of the column in order to permit both vertical sliding and tilting with respect to vertical of the head member.

6 Claims, 6 Drawing Figures

SYSTEM FOR DRILLING FROM A WATER SURFACE, WHICH IS INSENSITIVE TO THE SWELL

BACKGROUND OF THE INVENTION

The present invention relates to the field of drilling from a water surface or level and more specifically to mining or oil industry-type drilling operations for the purpose of carrying out rapid explorations of sites with a view to the possible subsequent working thereof.

An essential condition for carrying out such processes consists of exerting on the drilling tool a bearing stress, which is constant and normal to the surface to be perforated. This condition is obviously difficult to fulfil, when drilling takes place from a water surface and in this case only two solutions have been known up to now.

According to the first solution, a floating drilling platform is brought onto the site and then after installing pillars resting on the sea bed, the platform is raised above the water surface and it rests on the pillars. Thus, the same situation arises as when drilling on land.

According to the second solution, a barge is brought to the site and is anchored there. The top of the drill pipe string is equipped with a complicated swell or surge compensating apparatus, which serves to give the drill pipe string a vertical displacement equal and opposite to that of the barge, so as to obtain an overall zero displacement variation on the tool. In other words, the bottom point of the drill pipe string is fixed relative to the ground and the top point, which is linked with a moving point, is fixed in space.

These two types of drilling systems, which are essentially used in oil drilling operations, are costly at the initial investment stage, from the maintenance standpoint and in use.

Moreover, the drilling systems of the second type with pounding compensation, pounding being the phenomenon due to the cyclic action of variable vertical pressure stresses on the bottom point of the drill pipe string, are only effective when the string is relatively elastic, i.e. when it has a considerable length, so that in the case of limited water depths, it is more difficult to obtain compensation and drilling is less efficient.

SUMMARY OF THE INVENTION

The present invention proposes a novel type of drilling system starting from the water surface and which is insensitive to the surge or swell. This system is simpler and therefore more economic, both in its concept and in its performance than prior art systems. The optimized efficiency thereof is also independent of the height of the water.

The present invention therefore proposes a system for drilling from a water surface, of the type having means for exerting and maintaining on the drilling tool a bearing stress, which is constant and normal to the surface to be perforated, no matter what the effect of the swell, wherein it comprises in combination:

a base having a central passage for the drill pipe string of a drilling apparatus, which is intended to rest on the sea bed and is elastically connected to means for receiving a cylindrical box;

a column formed by a cylindrical tubular central guide, for permitting the passage and guidance of the drill pipe string of the drilling apparatus, the column being surrounded by an external cylindrical tubular envelope, the hollow annular space formed between the central guide and the envelope being subdivided into a tight chamber constituting a lower ballast, a tight intermediate chamber of variable length determined as a function of the mean depth of the section of water under which drilling takes place, a tight chamber constituting an upper ballast and a head chamber, the total height of column exceeding the maximum depth of the section of water, the lower cylindrical part of the column being shaped so that it is placed in reception means of the base and the head of the column supporting a platform for installing the drilling apparatus; and a barge moored by anchor lines on the site where drilling is to take place, which is provided with an annular collar receiving with a clearance the same head of the column in order to permit both vertical sliding and tilting with respect to the vertical of head member.

The essential originality of the drilling system according to the invention consequently consists of protecting the drill pipe string from the effect of pounding, by placing the drilling apparatus on the upper end of a substantially vertical hollow column, whose height exceeds the maximum depth of the section of water. Thus, there is no longer any compensation to be carried out on the drill pipe string surrounded by the hollow column, which can slide freely in the vertical direction or can tilt relative to the barge, when the latter rises and falls, or performs limited horizontal movements under the action of the swell.

A further aim of the invention is to obviate preparations of the area to be drilled with heavy civil engineering equipment.

Therefore, the present invention also relates to a drilling system as defined hereinbefore, wherein the elastic connection between the lower cylindrical part of the column and the base is provided by the hemispherical shaping of lower part and by the provision of a hemispherical reception support for lower part with the interposition between them of stacks of hemispherical plates, alternately made from hard material and elastic material.

A further aim of the invention is to reduce the effects of vibrations of the column.

Therefore, the invention also relates to a drilling system as defined hereinbefore, wherein the drilling platform only supports the active part of the drilling apparatus comprising the mast, the hoists, the lifting means and the controls, the remainder of the drilling apparatus consisting of the motors, pumps, as well as other winches and lifting means being located on the barge.

The invention also relates to a number of ancillary constructional characteristics, which will be described hereinafter.

BRIEF DESCRIPTION OF THE DRAWINGS

The invention is described in greater detail hereinafter relative to non-limitative embodiments and the attached drawings, which show.

DETAILED DESCRIPTION OF THE INVENTION

Figure 1:
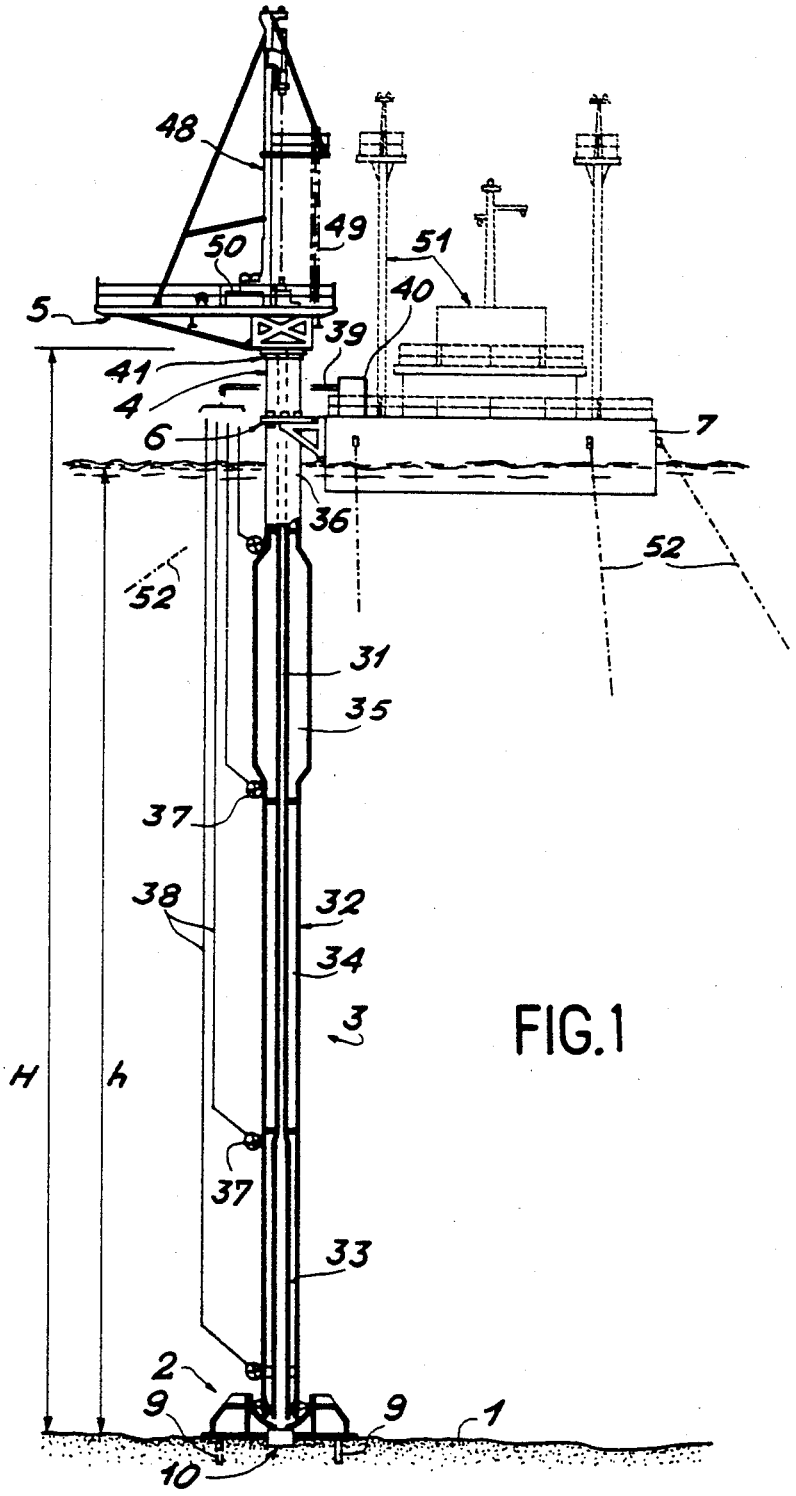
FIG. 1 diagrammatically in partial section and in partial side view, the combined means according to the invention.

The drilling system diagrammatically shown in FIG. 1 is used for carrying out a drilling operation in the ground 1, under a section of water of depth h.

It essentially comprises a base 2 resting on the ground, the base elastically supporting a hollow column 3, whose total height H exceeds the maximum value of the depth of the section of water. The head member 4 of column 3 supporting drilling platform 5 is guided with a clearance in a guide collar 6 mounted on a barge 7.

Figure 2:
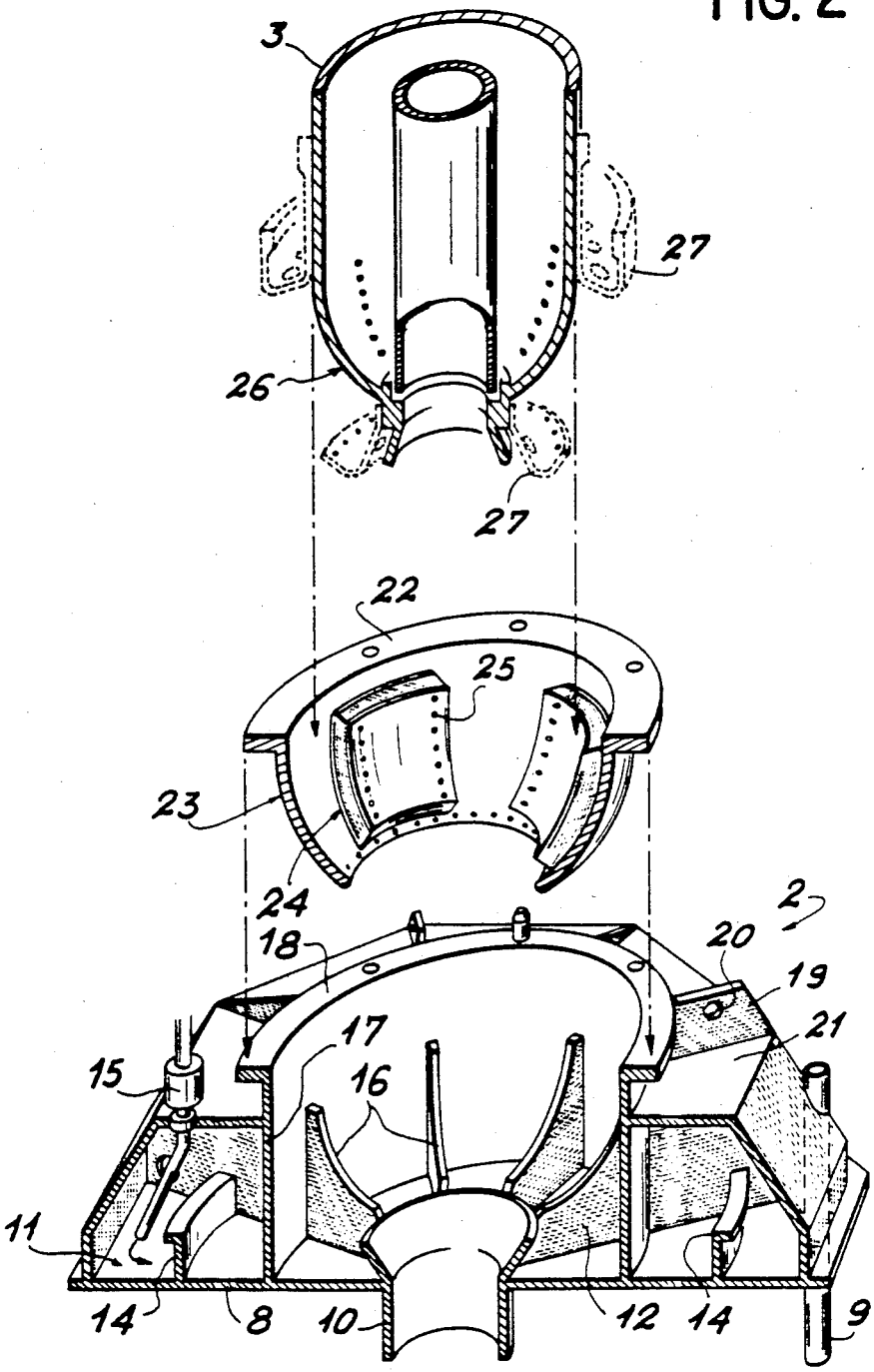
FIG. 2 in a part sectional exploded perspective view, the base and the elastic supporting means of the foot of the column of the drilling system.
Figure 3:
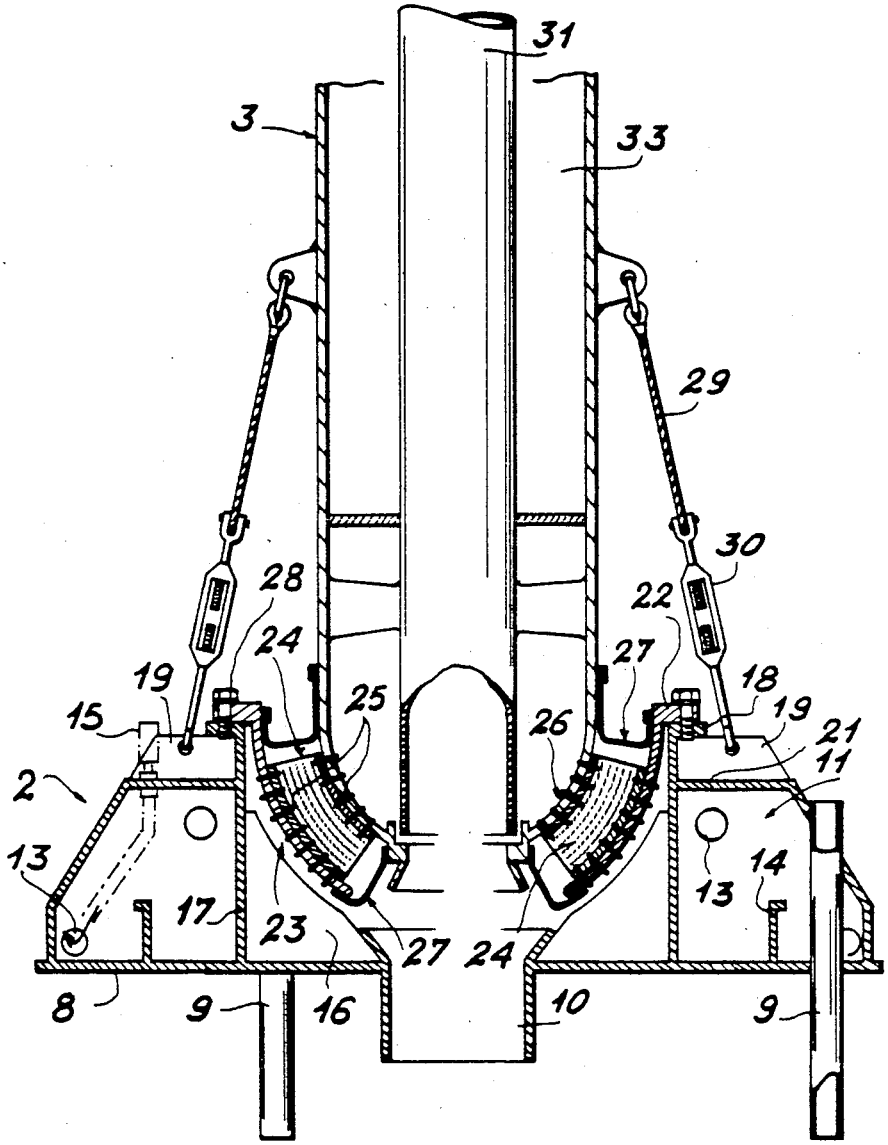
FIG. 3 in axial section, the same components, in the manner in which they are assembled during transportation and installation of the column.

FIGS. 2 and 3 show in greater detail the construction of base 2 and its elastic assembly with the bottom of column 3. The base, which is produced by mechanical welding, has a base plate 8.

Below plate 8 are provided components forming spades, which are inserted into the ground 1. These spades comprise, e.g. three tubes 9 and a central tube 10, which also permit the passage in its central part of the drill pipe string of the drilling apparatus.

Above plate 8 is provided the actual base 2, which comprises a peripheral caisson 11, subdivided by reinforcing partitions 12 and provided with openings 13 linking the various subdivided areas and stiffened by shaped sections 14. Caisson 11 can act as ballast under the control of valves 15 as will be explained hereinafter.

Spacers 16 are interposed between a straight cylinder 17 having an upper flange 18 and the upwardly widened central tube 10. Other spacers 19, provided with perforations 20, placed between the upper part of cylinder 17 and upper plate 21 of caisson 11, reinforce the stiffness and strength of the base.

Flange 18 supports flange 22 of a hemispherical member 23, which has a central opening and is integral with the foot of column 3. The hemispherical interior of member 23 is used for supporting successive stacks of hemispherical plates 24, alternately made from steel and neoprene and held together by gluing, as well as by studs 25 on member 23 and the also hemispherical base 26 of the foot of column 3. The stack of alternately rigid and flexible plates 24 constitutes an elastic coupling ball joint between the foot of column 3 and base 2. Flexible joints 27 enclose and protect the elastic ball joint.

FIG. 3 shows the assembly as used for transportation and installation of the column. The two flanges 18 and 22 are then assembled by bolts 28 and base 2 is also rigidly connected to the bottom of column 3 by slings 29 with turnbuckles 30.

As is shown in FIG. 1, column 3 is formed by a cylindrical tubular central guide 31, for permitting the passage and guiding the drill pipe string of the drilling apparatus (not shown). Central tube 31 is surrounded by an external cylindrical tubular envelope 32.

The annular space formed between cylinders 31 and 32 is subdivided into a tight chamber constituting a lower ballast 33, a tight intermediate chamber 34, whose length can vary as a function of the drilling sites and is determined as a function of the mean value of the depth h of the section of water under which drilling is to take place, a tight chamber constituting an upper ballast 35 and having a larger diameter, and a head chamber 36, within the head bore of column 3.

The lower and upper ballasts 33, 35 are controlled by valves 37, connected by pipes 38, which are themselves connected by flexible tubes 39 to a control station 40 on barge 7. In practice, the pipes 38 are located within the hollow column 3.

Figure 5:
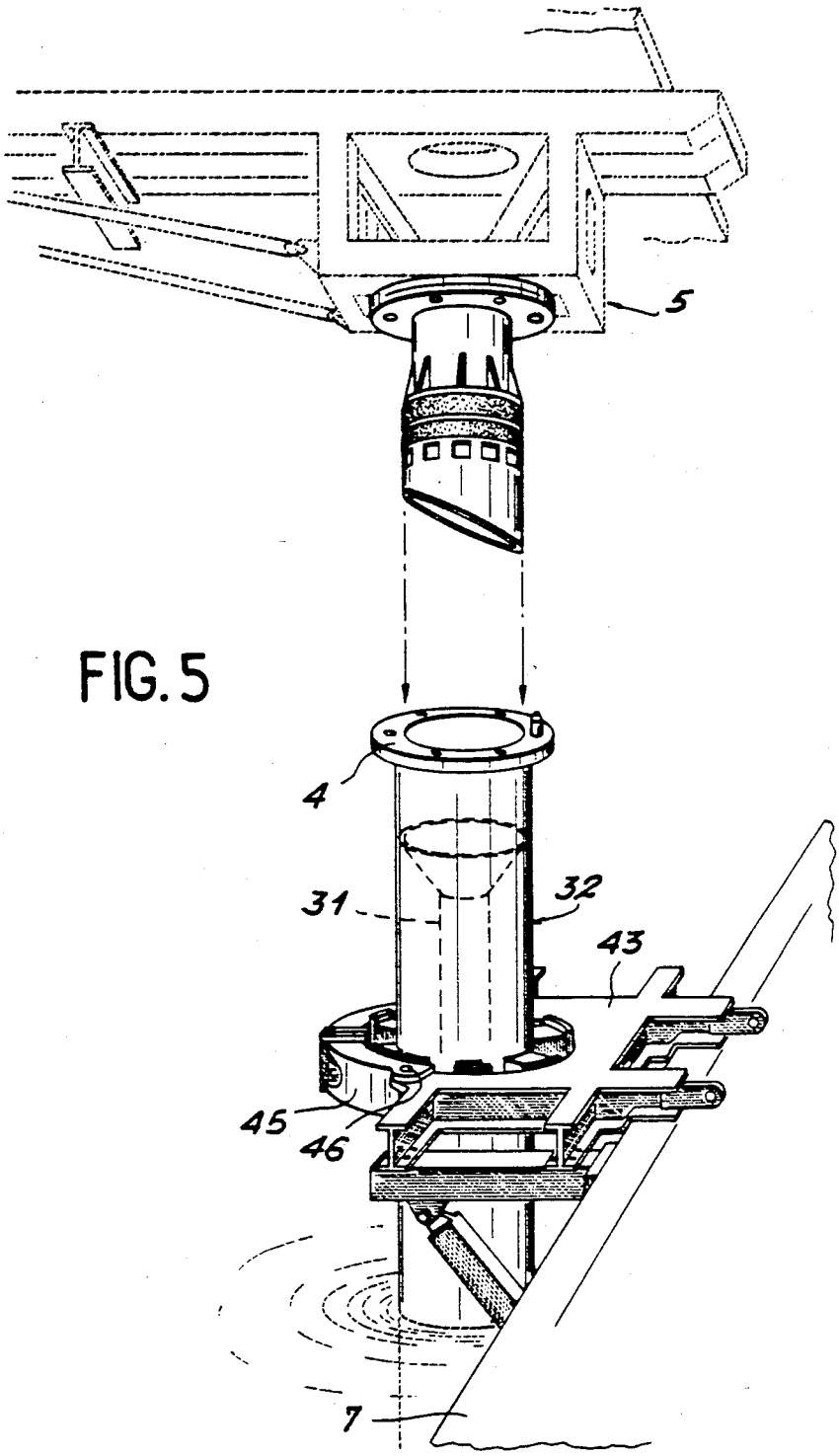
FIG. 5 a perspective view, the manner in which the drilling platform is installed on the column head member.

The head 4 of column 3 is terminated by a flange 41, on which is mounted by bolting the actual drilling platform 5, as can also be seen in FIG. 5. The total height H of column 3, between base 2 and flange 41, exceeds the maximum depth of the section of water h.

Figure 4:
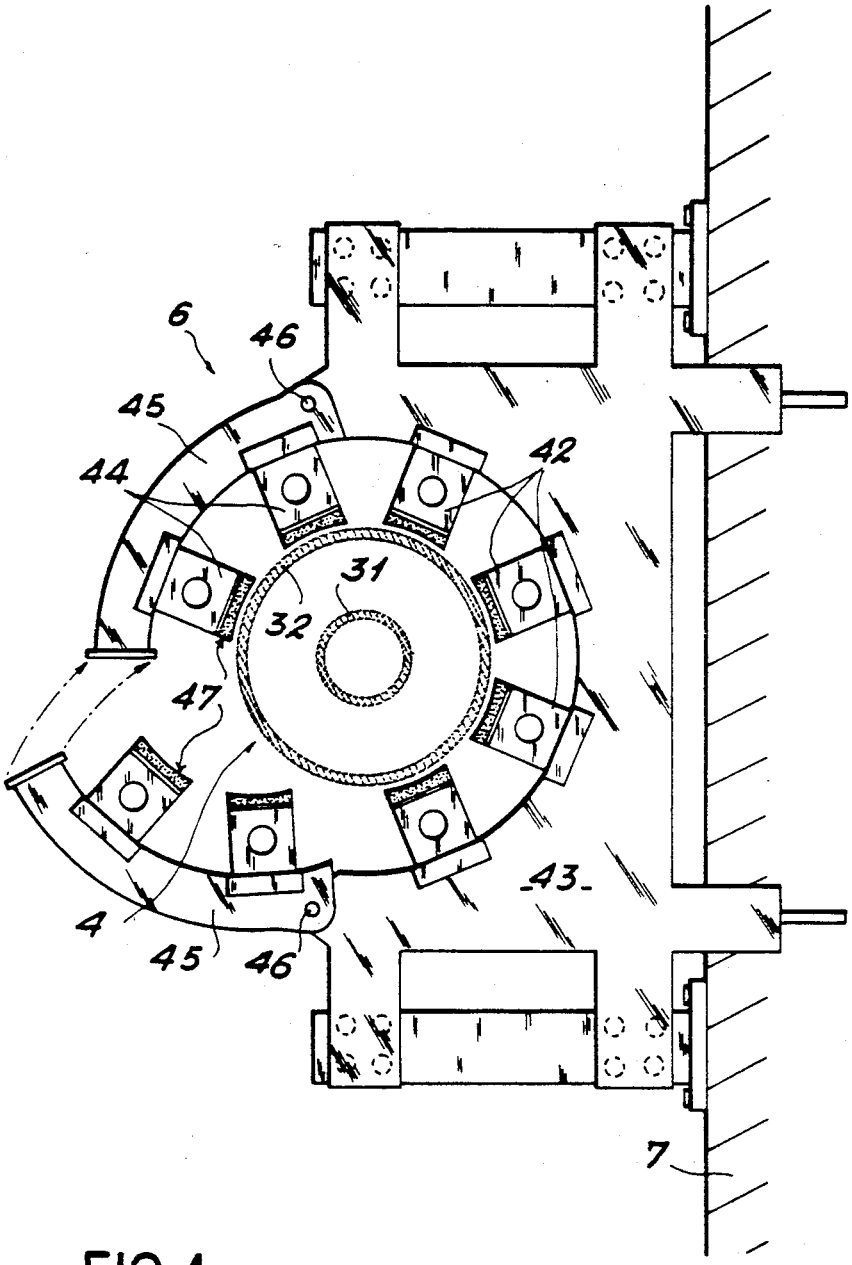
FIG. 4 in plan view, the annular collar for maintaining the guidance with clearance of the column head member, the collar being installed on the barge.

Head 4 of column 3 is guided with clearance in a collar 6 carried by barge 7 and which is shown in greater detail in a FIG. 4. Collar 6 has four friction pads 42, fixed in semicircular manner to a support 43, integral with the barge. Four other friction pads 44 are mounted on two quarter circle arms 45, which pivot about spindles 46 on support 43. Rubber blocks 47 are used as shock absorbers between head 4 and collar 6.

According to a feature of the invention, on drilling platform 5 is only mounted the active part of the drilling apparatus consisting of mast 48, the winches and drilling means 49 and certain controls 50. The remainder of the drilling apparatus consisting of motors, other winches and lifting means 51 are located on barge 7.

The per se known barge 7 is equipped with dwelling areas and functional equipment associated with the drilling apparatus and its use. Thus, it is stabilized in position by ballasts. It is equipped with lifting means, winches, pumps, tanks and electricity-generating equipment. It is connected by mooring lines 52 to anchors.

The operation of the drilling system according to the invention will now be described. By welded assembly on land the desired length H of column 3 is prepared as a function of the site, where drilling is to take place. This length H is adjusted by varying the length of the intermediate chamber 34. Base 2 is put into place and is joined to the foot of the column by bolts 28 as well as slings 29 and turnbuckles 30 (FIG. 3). Ballasts 11, 33 and 35 are filled with air. The column and its base are then put into the water and float horizontally. The thus unballasted system is then towed to the drilling site.

The barge is transferred to the drilling site and attached to the previously moored anchor lines. The barge is oriented parallel to the direction of the long swell which, for lagoons or ocean areas closed by a channel, corresponds to the swell formed in the ocean and entered by the channel. The drilling equipment is placed on the side opposite to the prevailing wind.

This is followed by the progressive sloping of the column by successive lifting stages with the crane from the barge of the column head and the partial ballasting of the lower ballast 33. It is ensures that each sloping stage corresponds to a stable inclined position of the column. This is continued up to the end of ballasting of the foot of the column. The upper ballast is partially and progressively ballasted until the column floats vertically, it being secured from the barge by the crane.

The head member 4 of the column is then introduced into the guide collar 6, whose moving arms 45 are then closed. The column still does not rest on the sea bed. The upper ballasting is finished and then, using the crane, the column and its base are placed on the sea bed.

Divers then remove the slings connecting the column head to the crane and the barge, the flexible ballasting tubes, the connecting slings between the column foot and the base, together with the bolts attaching flanges 18 and 22. The column now rests freely on the elastic ball joint of the base. The installation is ready for drilling operations. The latter are of a conventional nature and will not be described here.

Figure 6:
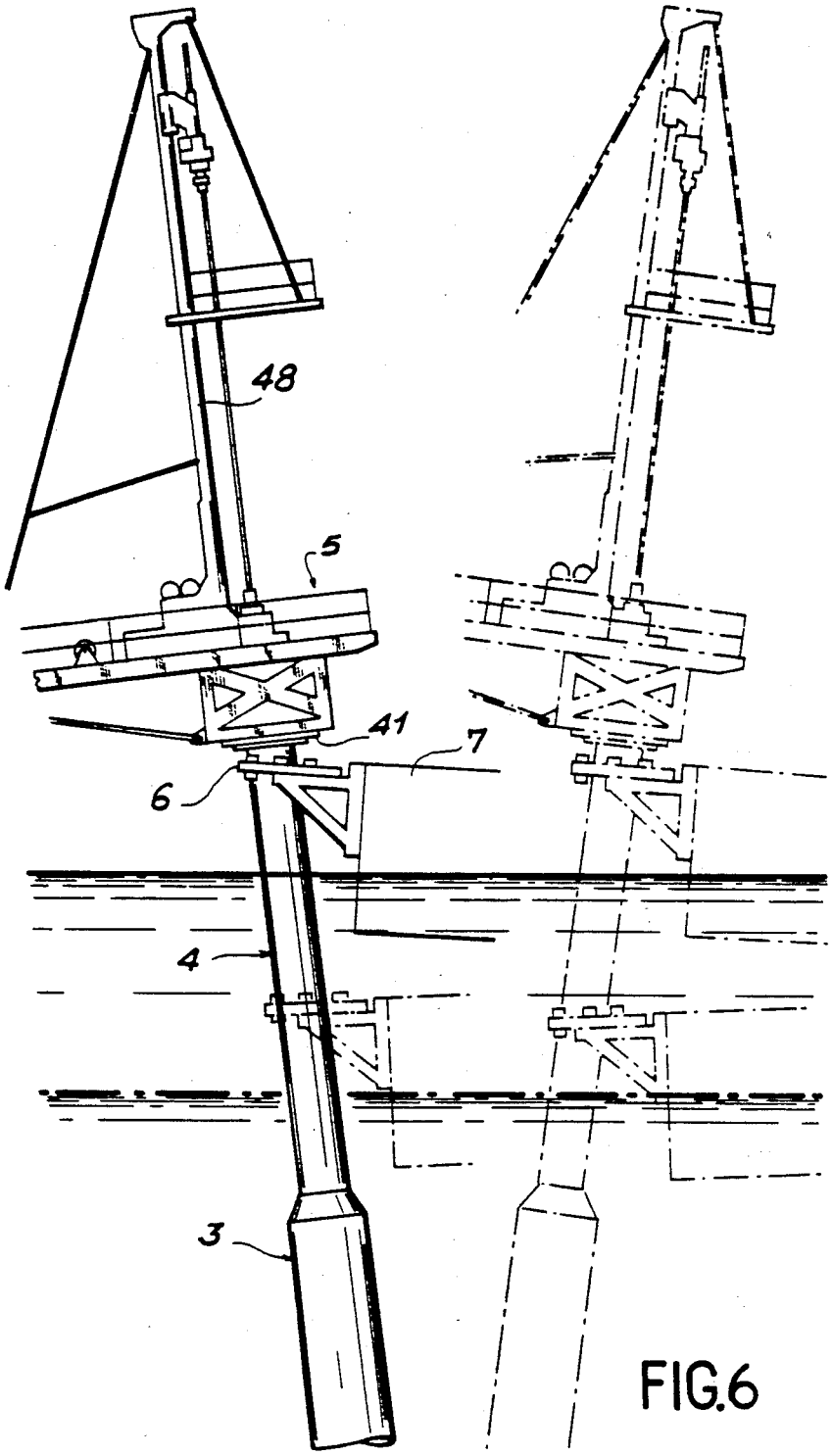
FIG. 6 a side view of the column head member carrying the drilling platform, the guidance collar of said member, and the barge in order to illustrate the different respective positions which can be occupied by the column and the barge under the effect of the swell.

FIG. 6 illustrates the possibilities, for the drilling column 3, of either pivoting freely around the elastic ball joint of its base, whilst including with respect to the guide collar 6, when the barge is subject to limited horizontal movements, or of freely vertically sliding within the guide collar 6, when the barge rises or falls under the action of the swell.

After carrying out drilling operations, the drilling system is moved in the manner described hereinafter. The column head is attached by slings to the crane. The column head is partly deballasted and then completely deballasted whilst the column is raised by means of the crane. In successive stable stages, the column is brought into the horizontal floating position by progressively deballasting the foot of the column.

The base which has been left on the sea bed is then recovered by cable. This operation involves the use of divers for attaching the cable. The caisson of the base is deballasted when the base is a few meters below the water surface.

Apart from the essential advantages referred to hereinbefore, it is also pointed out that the procedure of using the drilling system, which consists of horizontally floating the column to the site, then bringing it into the vertical position by successive ballasting operations controlled from the surface by means of the barge, then introducing it into the guide collar and placing it again on the sea bed by ballasting, is of a simple nature and requires no complex dynamic control means, as is the case for self-raising drilling platforms.

Moreover, as it is a question of exploration work on ground surfaces having an unknown terrain, the securement of the drilling apparatus is assured in the following way. The ballast is adjusted so that the column also has a slightly negative buoyancy, in order to place it on the sea bed. If the surface of the sea bed caves in, as a result of its flange 41, column 3 abuts against the guide collar 6 which is integral with the barge, which ensures the buoyancy of the column - barge assembly. The equipment and personnel on board are in complete safety, the barge tilting only slightly, i.e. by approximately 1°.

Marine structures are very much subject to damage by fatigue to their component parts, when they are subject to cumulative cyclic stresses. In the case of the present invention, this type of damage is minimized because the column, which is the distinctive component of the system, is largely protected from the action of the swell. Thus, the top of the column is well above the swell action area. Moreover, the section of the column subject to the swell, i.e. that close to the surface of the water, is minimized.

This system can be used for drilling operations in a few dozen meters and for drilling operations up to almost a thousand meters. This drilling system also makes it possible to carry out both linear and non-linear drilling operations.

Compared with self-raising platforms, the drilling system according to the invention leads to a decrease in capital costs by a factor of eight and in operating costs by a factor of four.

What is claimed is:

1. A system for drilling from a water surface, of the type having means for exerting a bearing stress on a drilling tool along a direction normal to a sea bed surface to be drilled which is constant during swells, comprising a drilling apparatus including:

(a) a drill pipe string connected to said drilling tool;

(b) a base having a central bore for passage of said drill pipe string, said base being formed to rest on said sea bed;

(c) a column comprising a cylindrical tubular central guide for guiding said drill pipe string and an external cylindrical tubular envelope surrounding said central guide, said central guide and said envelope forming a hollow annular space which is subdivided into a tight chamber at the foot of said column having a first predetermined length and constituting the lower ballast, a tight intermediate chamber having a length determined as a function of the mean depth of water at a drilling site, a tight chamber having a second predetermined length and constituting an upper ballast, and a head chamber at the head of said column, the total length of said column being greater than the maximum depth of water at said drilling site;

(d) a platform for installation and operation of said drilling apparatus, said platform being supported on said head of said column;

(e) elastic coupling means arranged between said column and said base, with said base having reception means formed therein for receiving said elastic coupling means; and wherein (f) an adjacent, but separate barge, from said drilling apparatus having anchor lines also independent of said drilling apparatus, for mooring at said drilling site and having an annular collar for receiving the head of said drilling apparatus column, said annular collar and said head having a clearance therebetween for enabling axial sliding and tilting of said head with respect to the vertical direction of said head member.

2. A drilling system as defined in claim 1, wherein said elastic coupling means comprises stacks of semi-spherical plates alternately made from rigid material and elastic material.

3. A drilling system as defined in claim 1, wherein only the active components of said drilling apparatus are arranged on said platform, said active components including a mast, a hoist, a first lifting means, and a control means, the remaining components of said drilling apparatus, including motors, pumps, winches, and a second lifting means, being located on said barge.

4. A drilling system as defined in claim 2, wherein securement means are provided for rigidly joining the lower part of said column and said base during the transport of said column in a horizontally floating position corresponding to a deballasted state of said upper and lower ballasts.

5. A drilling system as defined in claim 4, wherein said securement means comprise a flange formed on said elastic coupling means and a flange formed on said reception means, said flanges being provided with bores for enabling rigid coupling of said elastic coupling means and said base, and further comprising a plurality of slings connecting said lower part of said column and said base, each of said slings being provided with a turnbuckle.

6. A drilling system as defined in claim 1, wherein said annular collar formed integrally with said barge comprising a semi-circular part and a pair of arc-shaped arms pivotably mounted on said semi-circular part for receiving said head of said column.

* * * * *